US010472767B2

(12) United States Patent
Henry et al.

(10) Patent No.: US 10,472,767 B2
(45) Date of Patent: Nov. 12, 2019

(54) METHOD OF REMOVING ODORS FROM FIBROUS MATERIALS USED IN FORMING BIOCOMPOSITE MATERIALS

(71) Applicant: CNH Industrial Canada, Ltd., Saskatoon (CA)

(72) Inventors: James Henry, Saskatoon (CA); Satyanarayan Panigrahi, Saskatoon (CA); Radhey Lal Kushwaha, Saskatoon (CA)

(73) Assignee: CNH Industrial Canada, Ltd., Saskatoon, Saskatchewan (CA)

( * ) Notice: Subject to any disclaimer, the term of this patent is extended or adjusted under 35 U.S.C. 154(b) by 17 days.

(21) Appl. No.: 14/755,603

(22) Filed: Jun. 30, 2015

(65) Prior Publication Data

US 2017/0002514 A1 Jan. 5, 2017

Related U.S. Application Data

(63) Continuation of application No. 14/662,879, filed on Mar. 19, 2015, now Pat. No. 9,915,030.

(51) Int. Cl.
*D21C 9/00* (2006.01)
*D21C 9/06* (2006.01)
(Continued)

(52) U.S. Cl.
CPC ..... *D21C 9/001* (2013.01); *D06L 1/12* (2013.01); *D21C 7/12* (2013.01); *D21C 7/14* (2013.01);
(Continued)

(58) Field of Classification Search
CPC ..... D21C 9/001; D21C 9/005
See application file for complete search history.

(56) References Cited

U.S. PATENT DOCUMENTS 4,194,032 A 3/1980 Harper, Jr. et al.
5,562,740 A 10/1996 Cook et al.
(Continued)

FOREIGN PATENT DOCUMENTS

CA 2224594 1/2002
EP 1668182 3/2014
EP 16681862 3/2014

OTHER PUBLICATIONS

Wielen et al., Enhanced wet tensile properties via dielectric-barrier discharge, 2005, Holzforschung, vol. 59, p. 65-71.*
(Continued)

*Primary Examiner* — Anthony Calandra
(74) *Attorney, Agent, or Firm* — Rebecca L. Henkel; Rickard K. Demille

(57) ABSTRACT

A method to treat fibrous materials for use in the formation of a biocomposite material that significantly reduces or eliminates the odors emitted from the fibrous materials is provided. In the method, the fibers or fibrous materials are initially treated to extract the raw fiber from the source plant material and the remove unwanted fractions of the fiber, such as the hemicellulose, lignin, and pectin, among others, leaving only the intact cellulose fibers. These cellulose fibers are then further processed in a second step to remove the odor from the cellulose fibers. The second step includes a combination of a second chemical treatment, dehumidification, and/or a cold plasma modification to render the cellulosic fibers odorless.

4 Claims, 1 Drawing Sheet

(51) Int. Cl.

| | |
|---|---|
| ***D21C 9/10*** | (2006.01) |
| ***D21C 7/14*** | (2006.01) |
| ***D21C 7/12*** | (2006.01) |
| ***D21C 9/02*** | (2006.01) |
| ***D06L 1/12*** | (2006.01) |

(52) U.S. Cl.
CPC ..... *D21C 9/005* (2013.01); *D21C 9/007* (2013.01); *D21C 9/02* (2013.01); *D21C 9/06* (2013.01); *D21C 9/10* (2013.01); *D10B 2201/01* (2013.01)

(56) References Cited

U.S. PATENT DOCUMENTS

| | | | | |
|---|---|---|---|---|
| 5,582,644 | A * | 12/1996 | Gaddis | D06B 1/02 118/303 |
| 5,756,721 | A | 5/1998 | Eden et al. | |
| 8,007,635 | B2 * | 8/2011 | Tan | D21C 9/002 162/70 |
| 20,148,518 | | 6/2012 | Hamed et al. | |
| 2003/0091754 | A1 * | 5/2003 | Chihani | D04H 1/425 427/580 |
| 2007/0020452 | A1 | 1/2007 | Hamed et al. | |
| 2007/0093408 | A1 | 4/2007 | Moore et al. | |
| 2007/0270070 | A1 | 11/2007 | Hamed | |
| 2014/0262086 | A1 | 9/2014 | Nonni et al. | |
| 2014/0273704 | A1 | 9/2014 | Baer et al. | |

OTHER PUBLICATIONS

Jung et al., The Effect of Argon Cold Plasma on Water Absorption of Cotton (abstract only), 1977.*

Rydholm, Pulping Processes, 1965, Interscience Publishers, chapter 15.*

Kalia et al., "Cellulose-Based Bio- and Nanocomposites: A Review", International Journal of Polymer Science, vol. 2011, p. 1-35 (2011).

Faruk et al., Biocomposites reinforced with natural fibers: 2000-2010 Review Articles, Progress in Polymer Science, vol. 37, Issue 11, Nov. 2012, pp. 1552-1596.

Zhu et al., "Recent developments of flax fibres and their reinforced composites based on different polymeric matrices", Materials 6, 2013, 5171-5198.

Ramamoorthy, S.K., "Properties and Performance of Regenerated Cellulose Thermoset BioComposites", Thesis for the Degree of Doctor of Philosoophy, University of Boras, Mar. 2015, http://urn.kb/se/resolve?urn=urn:nbn:se:hb:diva-26.

Michel et al., "Preparation ofccellulosic fibers from sugarcane for textile use", Conference Papers in Materials Science (Article ID 651787), 2013, http://dx.doi.org/10.1155/2013/651787.

PCT/IB2015/001266, International Search Report and Written Opinion, dated Mar. 7, 2016, 8 pages.

* cited by examiner

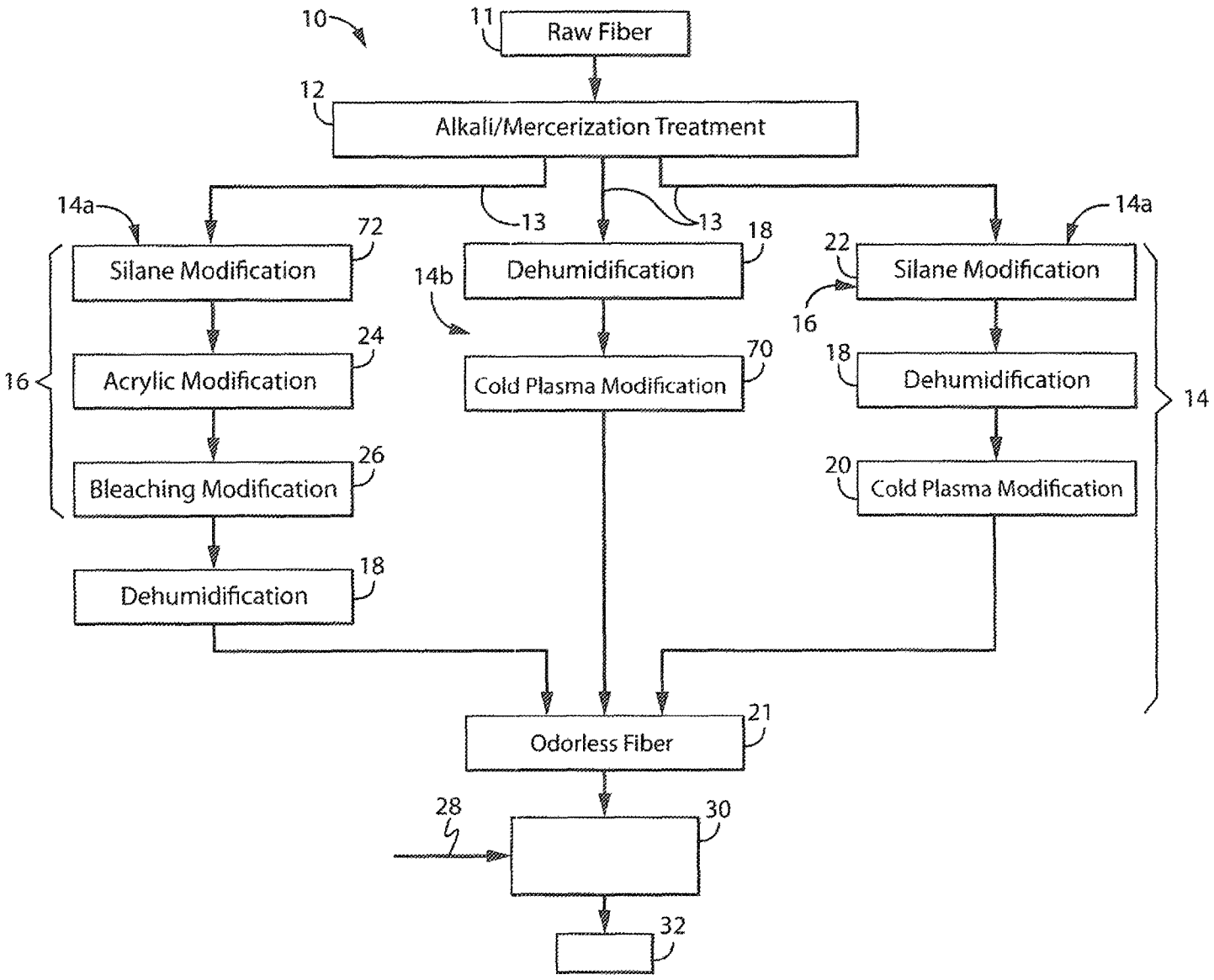
Raw Fiber
11
10
Alkali/Mercerization Treatment
12
13
13
Silane Modification
14a
22
16
Dehumidification
18
Cold Plasma Modification
20
14
Dehumidification
18
14b
Cold Plasma Modification
70
Silane Modification
72
14a
Acrylic Modification
24
Bleaching Modification
26
Dehumidification
18
16
Odorless Fiber
21
28
30
32

METHOD OF REMOVING ODORS FROM FIBROUS MATERIALS USED IN FORMING BIOCOMPOSITE MATERIALS

CROSS-REFERENCE TO RELATED APPLICATIONS

This application claims priority as a continuation-in-part of U.S. Non-Provisional patent application Ser. No. 14/662,879, filed on Mar. 19, 2015, the entirety of which is expressly incorporated by reference herein.

FIELD OF THE INVENTION

The subject matter disclosed herein relates generally to biocomposite materials and, in particular, to a method and system to remove undesirable odors in the fibers/fibrous material utilized in forming the biocomposite materials.

BACKGROUND OF THE INVENTION

Fibrous materials such as straw from flax, sisal, hemp, jute and coir, banana, among others, are used or combined with various polymers in the formation of biocomposite or bio-fiber composite materials. Biocomposite materials utilizing these fibrous materials or fibers mixed with selected polymers provide enhanced desirable properties compared with polymer-only materials. For example, biocomposite materials have the advantageous qualities of light weight, enhanced strength, corrosion resistance, design flexibility, inexpensive production, and environmental friendliness, among others over materials only formed from polymers.

However, regardless of these many beneficial properties, when natural fibers or fibrous materials are utilized, odors are created from the breakdown of natural fibers during fiber processing, when the fibers are subjected to high temperatures. These odors can be retained in the biocomposite material after processing, making products formed from those biocomposite materials that utilize natural fibers undesirable. To attempt to address this issue, alternative fiber processing steps have been utilized that minimize the intensity and duration of the heat that the fibers are exposed to reduce the amount of odor emitted by the processing of the fibers. However, because the fiber must be exposed to heat at some point during processing in order to properly condition the fibers prior to use in forming the biocomposite material, these attempts have been unsuccessful.

Other attempts to alleviate the odors present in these types of fibrous materials utilize odor-reducing or eliminating additives such as, deodorants, fragrances, and antimicrobials that are intermixed directly with the fibrous material and incorporated into the biocomposite materials. Some examples of the incorporation of these type of odor eliminating agents, which normally take the form of oxidizing agents, such as hydrogen peroxide, are disclosed in US2007/0020542, US2012/0148518; and U.S. Pat. No. 5,562,740, each of which are expressly incorporated by reference herein in their entirety.

In these examples, while the fibrous materials including these coatings have reduced odors due to the presence of the oxidizing agents applied to the fibrous materials, the presence of the oxidizing agents adds an additional step to the treatment of the fibrous materials, and creates issues with regard to the recycling of the biocomposite materials as a result of the presence of the oxidizing agents.

As a result, it is desirable to develop a method for processing and/or modifying the natural fibers to remove unwanted odors that does not require additional steps in the processing off the fibrous materials and that does not require additives to be incorporated with the fibrous materials within the resulting biocomposite materials.

SUMMARY OF THE INVENTION

According to one aspect of an exemplary embodiment of the invention, a method is provided to treat fibrous materials for use in the formation of a biocomposite material that significantly reduces or eliminates the odors emitted from the fibrous materials. In the method, the fibers or fibrous materials are initially treated to extract the raw fiber from the source plant material and the remove unwanted fractions of the fiber, such as the hemicellulose, lignin, and pectin, among others, leaving only the intact cellulose fibers. These cellulose fibers are then further processed in a second step to remove the odor from the cellulose fibers. The second step includes a combination of a second chemical treatment, dehumidification, and/or a cold plasma modification. After undergoing the second processing step, the cellulosic fibers are rendered odorless.

According to another aspect of an exemplary embodiment of the invention, the second step for rendering the cellulosic fibers odorless is performed prior to any further processing steps for the fibers or for the formation of the biocomposite material. In ordering the steps in this manner, the cellulose fibers are rendered odorless prior to any subsequent steps that subject the cellulose fibers to heat, thereby preventing any odor from being released from the cellulose fibers.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawing furnished herewith illustrates an exemplary embodiment of the present invention in which the above advantages and features are clearly disclosed as well as others which will be readily understood from the following description of the illustrated embodiments.

In the drawing:

The FIGURE is a schematic illustration of an exemplary embodiment of a method of removing odors from a fibrous material used to form a biocomposite material according to the present disclosure.

DETAILED DESCRIPTION OF THE INVENTION

With reference now to the drawing figure in which like reference numerals designate like parts throughout the disclosure, an exemplary embodiment of a method 10 for removing the odors from a fibrous material to be utilized in the forming of a biocomposite material formed of is illustrated.

In the illustrated embodiment, the method 10 includes an initial step 12 of an alkali/mercerization treatment of the raw fibers 11 to obtain the fibrous material 13 for use in the formation of the biocomposite. The raw fibers 11 can be selected from any suitable fibers used in the formation of biocomposites, and in an exemplary embodiment can be selected from flax, e.g., oilseed flax or fiber flax, hemp, coir, jute, banana fiber, sugar cane and sisal, among others. The initial step 12 can be any suitable step for separating the fibrous material 13, i.e., the cellulose fibers, from the remainder of the components of the raw fiber 11, including the lignin, hemicellulose, pectin, etc., such as, for example, by using those steps disclosed in co-owned and co-pending U.S. patent application Ser. No. 14/087,326, filed on Nov. 22, 2013, the entirety of which is expressly incorporated by reference herein.

After the initial step 12, the fibrous material/cellulose fibers 13 forming the output of step 12 are subjected to a separate odor elimination step or process 14. This odor elimination step or process 14 can be performed in multiple versions 14*a*-14*c*, with each version including a further chemical modification step 16, a dehumidification step 18, and/or a cold plasma modification step 20. The steps 16,18, 20 can be combined in various manners 14*a*-14*c* in order to achieve the odor elimination/reduction of overall step 14. In one exemplary embodiment, the odor elimination step 14*a* involves performing a chemical modification step 16 and a dehumidification step 18 on the fibrous material 13. In this embodiment, the chemical modification step 16 can take place in one or more wet chemical modification tanks, such as those disclosed in co-pending and co-owned U.S. Non-Provisional patent application Ser. No. 14/662,879, filed on Mar. 19, 2015, the entirety of which is expressly incorporated herein by reference.

In an exemplary embodiment of the chemical modification step 16, the cellulosic materials/cellulose fibers 13 are placed inside the tank, and the tank is filled to a specified level with the particular chemical solution necessary of the particular chemical treatment step 22,24,26 (silane/acrylic/bleaching solution) through an inlet port on the tank. Once the tank is closed, an electric motor connected to a propeller at the bottom of the tank is started, causing the chemical solution to circulate around the cellulose fibers 13 by moving up and down within the interior volume of the tank. This movement causes the maximum amount of the particular chemical in the solution to penetrate into the cellulosic materials/cellulose fibers 13 disposed within the tank to appropriately treat the cellulose fibers 13. After treatment of the cellulosic material/cellulose fibers 13 with the particular chemical solution has occurred for the desired residence time within the tank, the remaining chemical solution left in the tank is removed through an outlet of the tank. After removal of the chemical solution, a suitable washing solution is introduced into the interior of the tank to enable a washing process to be initiated to clean the cellulosic materials/cellulose fibers 13 that are retained within the tank after removal of the chemical solution. Once the washing process is complete, the washing solution is drained along with any remaining chemical solution through the outlet of the tank. The chemically modified and cleaned cellulosic materials/cellulose fibers 13 can then be removed from the tank for further processing.

With regard to the individual chemical treatment steps 22, 24 and 26 of the overall chemical modification step 16, these steps involve a silane modification. 22, followed by an acrylic modification step 24 and a bleaching modification step 26. Further, it is also contemplated that the steps 22-26 can be performed in other orders, and can include separate cleaning or washing steps between individual steps 22,24 and 26, as well as between the alkali step 12 and the initiation of the chemical modification step 16, as desired. In each case, while the steps 22, 24 and 26 each effect a modification of the fibers 13 to reduce and/or eliminate the odor generated by the fibers 13 when used to form a biocomposite material 32, the steps 22-26 do not detrimentally affect the internal structure of the fibers 13, thereby maintaining the beneficial strength and other properties of the fibers 13 when used in the biocomposite 32.

For the silane modification step 22, a suitable silane, such as, for example, vinyl triethoxysilane, is used to modify the cellulosic materials/cellulose fibers 13 after the alkali treatment step 12. As the number of suitable silanes that can be utilized in step 22 is large, the selection of specific silane compound depends on the polymer matrix used for the requirements of the particular applications of the end biocomposite product formed with the cellulose fibers 13. For example, when the polymer matrix to be used to form the biocomposite end product with the treated cellulose fibers 13 is polypropylene, polyethylene or mixtures thereof, a vinyl functionality of the selected silane compound is required.

In a particular exemplary embodiment of the steps 22-26, extracted (via the alkali step 12) and thoroughly washed wet cellulosic fibers 13 are placed in a solution containing alcohol (e.g., isopropyl alcohol) and water in a weight ratio of 60:40, which can vary depending upon the desired residence time (with more alcohol resulting in a shorter residence time) along with 1-4% w/w vinyl triethoxysilane as a coupling agent. The fibers 13 are retained in the solution, such as in the tank, for a residence time of between 30 min and 4 hours at 35-50° C. Experimental results demonstrated that fibers 13 treated according to steps 22-26 when used for manufacturing a biocomposite can withstand longer processing residence time compare to untreated fiber, improve mechanical properties and reduce moisture absorption along with the enhancement of the morphology of the fiber for better bonding between fiber and polymer matrix in forming the biocomposite. In particular, the silane modification end results are an increase in the interfacial strength, a stronger bonding between fiber and polymer matrix, a reduction in the moisture absorption and consequent reduction in odor. Afterwards, the silane solution is drained from the tank and the cellulosic material/cellulose fibers 13 are washed with distilled water in a washing step prior to further processing of the fibers 13.

After washing, the cellulosic material/cellulose fibers 13 are subjected to an acrylic modification step/acrylation process 24. This step 24 is performed in a similar manner to the silane modification step 22 described above. In particular, in the acrylic modification step 24 an aqueous solution of acrylic acid is placed within the tank and is used to contact and modify the surface of the cellulose fibers 13 added to the acrylic acid solution within the tank. Depending upon the strength of the acrylic acid solution, which in one exemplary embodiment is normally around 5-10% w/w or v/v of an aqueous acrylic acid solution, the residence time of the fibers 13 within the tank in step 24 varies from between 1 to 4 hours at 35-50° C., with a higher strength or concentration of the acrylic acid resulting in a shorter residence time. In one exemplary embodiment, the temperature is not elevated above this range to avoid placing thermal stress on the fibers 13 and thereby damaging the enhanced properties. Prior to processing the fibers 13 to make biocomposite raw material in the thermochemical process by using an extruder, attempt have been made to minimize the molecular thermal stress on the fibers 13. In addition, to further minimize the thermal stress, drying of the fibers 13 is conducted after wet chemical modification through a dehumidification chamber at low temperature. Upon completion of the modification of the fibers 13 by the acrylic acid solution, the acrylic acid solution is drained from the tank and the cellulosic material/cellulose fibers 13 are washed with distilled water in a washing step prior to further processing of the fibers 13. As a result of the treatment steps 22-26, the modification end results for the fibers 13 include optimization of the fiber interface with the polymer matrix, which can be utilized to make flexible composite product, such as, for example, a nano-sensor for biomedical applications, enhancement of the wetting between polymer and fiber, stronger bonding between the fibers 13 and the polymer matrix, reduction of the moisture absorption by the fibers 13, a reduction in the odor of the fibers 13, in part due to the reduction in moisture absorption, and less resistance of the fibers 13 to material flow during processing of a material including the fibers 13, such as the extrusion or molding of the biocomposite material including the fibers 13, due to the increased flexibility of the fibers 13.

Similarly to the prior steps 22 and 24, in an exemplary embodiment the bleaching modification step 26 is performed using a similar process involving placement of the cellulose fibers 13 within a suitable bleaching solution contained within a treatment tank for a specified residence time to effect the proper modification of the cellulose fibers 13 by the bleaching solution. For example, the bleaching solution can be formed with sodium chlorite as the bleaching agent or bleach in water, which in one exemplary embodiment is a solution of sodium chlorite and water in a ratio of 1:25, that is maintained at 35-50° C. within the tank to contact and modify the cellulose fibers 13 positioned in the tank in contact with the bleaching solution with a residence time of between 2-8 hours, depending upon the strength of the bleaching solution, with a higher strength or concentration of the bleaching agent in the solution resulting in a shorter residence time. Upon completion of the modification of the cellulose fibers 13, the bleaching solution is drained from the tank, and the modified cellulosic material/cellulose fibers 13 are subsequently washed in distilled water within the tank to remove any excess bleach from the fibers 13. Modification end results of step 26 on the fibers 13 include lowering the stiffness of fibers 13, increasing the fiber interface between polymer and fiber, enhancing the flexural strength of the composite, a stronger bonding between fiber and polymer matrix, eliminating the fiber odor and making fiber more water resistant. This treatment step 26 also helps to reduce the processing temperature and pressure required for forming the resulting biocomposite material into end products in various molding processes, such as extrusion and injection molding and rotational molding processes and also help to increase the production output in terms of reduction of processing time in the molding processes. After washing the fibers 13 the fiber 13 can be placed within an industrial spinner (not shown) to get rid of excess of water retained within the fibers 13.

Following the completion of the chemical modification step 16 including one or more of the component steps 22-26 and any intervening or post-component step washing processes, the fibrous material/cellulose fibers 13 are dehumidified in a dehumidification step 18. The dehumidification step 18 involves drying of the cellulosic material to remove the water contained in and on the modified fibers 13. In one exemplary embodiment, the dehumidification step 18 can take place in a dehumidification chamber or cabinet (not shown) and using a dehumidification method disclosed in co-owned and co-pending U.S. patent application Ser. No. 14/640,500, filed on Mar. 6, 2015, the entirety of which is expressly incorporated herein. In particular, the modified and wet cellulosic material/cellulose fibers 13 are placed on perforated wire mesh shelves inside the insulated dehumidification cabinet. The cabinet is then closed, and the dehumidifiers are turned on. The temperature in the cabinet is increased slightly (around 35° C.-50° C.), staying within the fiber's tolerable range. Thermocouples and relative humidity sensors on the cabinet monitor the air temperature and humidity inside the cabinet. The combination of increased temperature and dehumidifiers evenly dries the fibers to the desired moisture content. This process does not damage the internal structure of the modified cellulosic materials/cellulose fibers 13, thereby maintaining strength and reinforcement properties of the fibers 13. In addition, the dehumidification step 18 maintains a consistent moisture content across all fibers 13, reduced energy consumption, and improved fiber quality under a completely controlled dehumidifying environment.

As a result of the odor elimination step 14*a*, the fibers 13 are modified into the odorless fibers 21 that can then be used in subsequent biocomposite product formulations without causing odors.

In another exemplary embodiment shown in the figure, the odor elimination step 14*b* of the method 10 can include the dehumidification step 18 performed on the fibrous material/cellulose fibers 13 exiting step 12, followed by a cold plasma modification step 20. The dehumidification step 18 is similar to that utilized in the prior embodiment of the odor elimination reduction step/process 14*a*. The cold plasma treatment step 20 is performed in any suitable manner, and in an exemplary embodiment is performed in a cold plasma chamber and involves application of cold plasma to the fibers 13. The degree of ionization of the cold plasma is approximately 3% and the temperature is low compared to a hot plasma, such as around or slightly elevated from room temperature, such that the cold plasma reacts non-thermally to the surfaces of the fibers 13, thereby leaving unaffected the internal structure of the fibers 13 and maintaining the beneficial properties of the fibers 13. In one exemplary embodiment argon gas was used for the cold plasma which was generated as argon gas started to glow by using DC Glow plasma reactor operated at 400 V. The dried cellulosic materials/fibers 13 exiting the dehumidification process/step 18 were treated from between 5-15 minutes at a cold plasma temperature of about 39-51° C. Upon completion of the treatment step 20, the fibers 13 had a significantly reduced or eliminated odor.

In still another exemplary embodiment of the odor elimination/reduction step 14*c* shown in the figure, the odor elimination step 14*c* of the method 10 can include the chemical modification step 16 performed on the fibrous material 13 exiting step 12, followed by a dehumidification step 18, and a cold plasma modification step 20. The dehumidification step 18 and cold plasma treatment step 20 are similar to those utilized in the prior embodiments. In this embodiment, however, the chemical modification step 16 includes only the silane modification step 22, after which the dehumidification step 18 and cold plasma modification step 20 are performed on the fibrous material 13.

After the completion of the odor elimination/reduction step 14 in any of the various embodiments 14*a*-14*c*, the odorless fibrous material 21 can be combined with a selected and suitable polymer(s) 28 in a suitable processing step 30 to form the biocomposite material 32 output from the processing step 30. Any suitable processing manner can be utilized in step 30, including, but not limited to any extrusion, injection molding, compression molding, roto-molding, lamination, and/or hand layup processes. In addition, the types of polymer(s) 28 capable of being combined with the fibrous material 13 in step 30 include, but are not limited to, suitable thermoplastics and thermoset materials, elastomers, and rubbers. The biocomposite material 32 can subsequently be formed into pellets (not shown) of the biocomposite material 32 that are output form the processing step 30 and input into a suitable thermoforming process (not shown) to form an end product (not shown).

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A method for reducing/eliminating odors in a biocomposite material, the method consisting essentially of the steps of:

a) separating a fibrous material from a raw fiber; and b) treating the fibrous material with an odor elimination process prior to performing any step that subject the fibrous material to heat, the odor elimination process consisting of chemically modifying the fibrous material and at least one or more of the steps of: dehumidifying the fibrous material by heating the fibers to a temperature of between about 35° C. to about 50° C. and cold plasma modification of the fibrous material, wherein the method does not include the addition of an oxidizing agent to the fibrous material in the chemical modification step, wherein the step of chemically modifying the fibrous material comprises i) performing a silane modification on the fibrous material; and ii) performing an acrylic modification on the fibrous material, and wherein the method further consists essentially of the step of washing the fibrous material after the acrylic modification step.

2. The method of claim 1 further consisting essentially of the step of washing the fibrous material after each modification step.

3. The method of claim 1 wherein the raw fiber is selected from the group consisting of flax and hemp.

4. The method of claim 1 wherein the odor elimination process does not affect the internal structure of the fibrous material.

* * * * *